United States Patent [19]

Bielous

[11] Patent Number: 4,973,505

[45] Date of Patent: Nov. 27, 1990

[54] REVERSIBLE MAT

[76] Inventor: William Bielous, 842 Beauregard Street - Apt. 2, Sainte-Foy, Province of Quebec, Canada, G1V 4P4

[21] Appl. No.: 358,408

[22] Filed: May 30, 1989

[51] Int. Cl.[5] ..... E04C 1/10; B32B 3/06

[52] U.S. Cl. ..... 428/44; 428/58; 428/60; 428/83; 52/177; 52/593; 404/32

[58] Field of Search ..... 428/45, 48, 44, 60, 428/67, 83, 192; 404/41, 35, 33, 32; 52/181, 177, 593

[56] References Cited

U.S. PATENT DOCUMENTS

| | | | |
|---|---|---|---|
| 3,379,104 | 4/1968 | Scholl | 404/35 |
| 4,189,887 | 2/1980 | Gallant et al. | 52/311 |
| 4,287,693 | 9/1981 | Collette | 428/44 |
| 4,361,614 | 11/1982 | Moffitt | 428/44 |
| 4,468,910 | 9/1984 | Morrison | 428/45 |
| 4,766,020 | 8/1988 | Ellingson | 428/60 |
| 4,826,351 | 5/1989 | Haberhauer et al. | 404/41 |

FOREIGN PATENT DOCUMENTS

| | | | |
|---|---|---|---|
| 940322 | 6/1982 | U.S.S.R. | 52/177 |

*Primary Examiner*—Alexander S. Thomas

[57] ABSTRACT

Reversible quadrangular mats of similar construction are provided, defining a grille section on one face and a flat section on the opposite face, and interlocking edgewise joints to edgewisely releasably interlock the mats in coplanar fashion. These joints include thicknesswise grooves made at the peripheral side edge sections of each mat, defining two upturned edgewise lips in two adjacent grooves and two downturned edgewise lips in the two other grooves. The mats are made from a semi-flexible material. One side lip of a first mat is frictionally engageable into one side groove of a second mat, for their interconnection.

7 Claims, 4 Drawing Sheets

REVERSIBLE MAT

FIELD OF THE INVENTION

This invention relates to flexible mats to be used mainly as floor carpets/grilles.

BACKGROUND OF THE INVENTION

Drawbacks of prior art flexible mats are that when they become worn out, they have to be completely replaced, often at great expense when the mat has a large area; also, they usually have only a single useful surface; and they are not usually easily and efficiently securable to each other in coplanar fashion.

OBJECTS OF THE INVENTION

The goal of the invention is to provide means to easily interconnect a number of mats, in a releasable and coplanar fashion.

A supplemental goal is to provide such mats being of reversible nature, i.e. which can be used with one or the other of their main faces facing upwardly.

SUMMARY OF THE INVENTION

In accordance with the inventive concept, there is disclosed in combination, at least two reversible quadrangular mats of similar construction each defining a grille section on one face and a flat section on the opposite face, and means to edgewisely releasably interlock said mats in coplanar fashion; wherein said interlocking means defines a lengthwise groove, made at the peripheral section of at least one side edge section of each mat, each said groove defining a corresponding edgewise lip member, a lip member from one mat being engageable into the groove of the other mat, said mats being made from a semi-flexible material.

Preferably, said grille section is removable from said mat so as to define a large quadrangular grille section-receiving recess made into each said mat.

Advantageously, said semi-flexible material of the lip members is chosen from the group comprising: vinyl, elastomeric materials, and urethane.

Profitably, in each mat, said peripheral groove is made thicknesswisely of the four peripheral side edge sections of the mats, with two adjacent grooves being made on said one face thereof and the two others on said opposite face, said lip members being at the exterior edge of said grooves, said lip members and said grooves being cross-sectionally square for frictional releasable interengagement of a lip member from a first mat with a groove from a second mat.

In alternate embodiments, said lips and grooves are cross-sectionally semi-circular or preferably dovetailed for releasable interengagement, taking apart two mats being then more difficult. It is envisioned that said flat face section of each mat includes a plurality of spaced, water droplet-like, wear-resistant, circular, thin projections.

Preferably, said peripheral grooves and lip members extend on the four sides of each mat, the adjacent lip members defining free ends which are spaced from each other so as to constitute square corner free cavities in said grooves.

Advantageously, at least one ramp is provided, said ramp being thicknesswisely tapering and having at its thickest edge section a said groove and a said lip member for edgewise engagement with a corresponding groove or lip member from one mat.

Advantageously, the lip members and grooves of two adjacent side edge sections of each mat project beyond the side edges of said grille section, and the other lip members and grooves from same mat project beyond the side edges of said main face section.

DETAILED DESCRIPTION OF THE INVENTION

Mat 10 is substantially quadrangular and made from an elastomeric material, such as rubber, vinyl, urethane, and the like elastomeric materials, and forms a quadrangular figure in plan view. Mat 10 defines two opposite main faces 12, 14. Face 12 is substantially flat and may include a plurality of wear-resistant, water droplet-like, spaced, circular, thin projections 16. Face 14 defines an integral grille 18.

Mat 10 may be used in a large variety of decorative and/or utilitarian settings: on the ground in front of houses, restaurants; at the peripheral section of icerinks of arenas; for boardwalks, streets, overpasses, public buildings, hallways, the workplace, in a basement; for the industry: liners for sandblasting machines, chutes; and generally speaking, on any floor, wall or ceiling but most profitably on floors.

Figure 1:
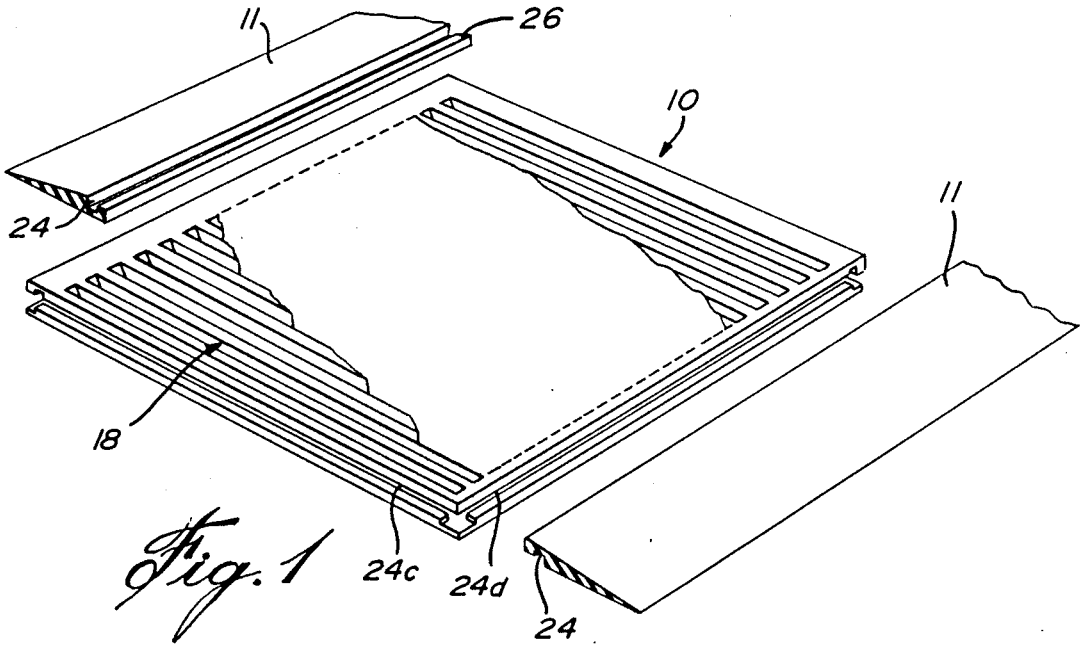
FIG. 1 is a partly broken perspective view of the top face of a first embodiment of reversible mat according to the invention, suggesting how the thicknesswisely tapering side ramps can be edgewisely connected to two opposite sides thereof.
Figure 6:
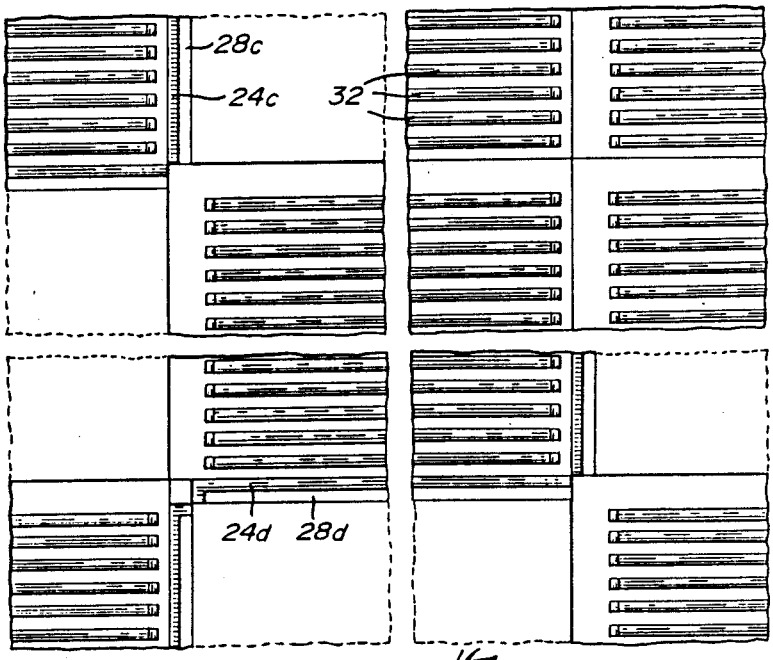
FIG. 6 is a partly broken plan view of a number of mats which are edgewisely interlocked accordingly with the teachings of the invention.
Figure 7:
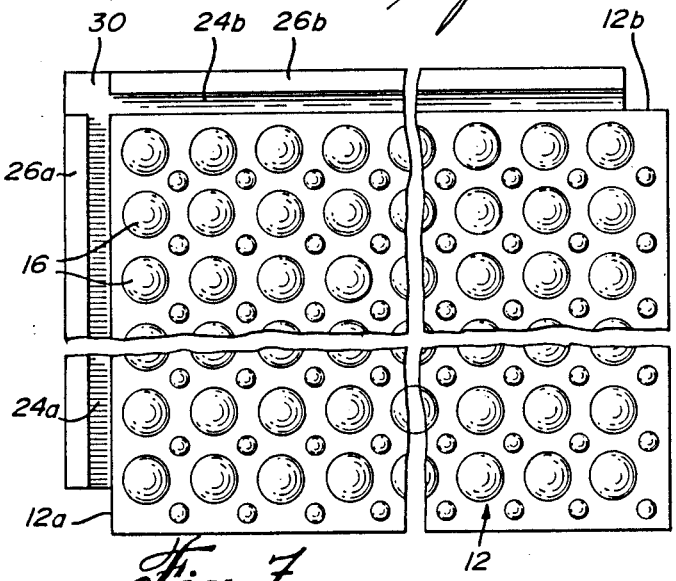
FIG. 7 is an enlarged partly broken view of a corner portion of the mat, showing its face opposite that of FIG. 3.

In accordance with the invention, the reversible mat 10 is to be used cooperatively with other mats 10, i.e. with at least one and preferably several mats, being edgewisely interconnected in coplanar fashion as suggested in FIG. 1 and as illustrated in FIG. 6. The reversible mats 10 are interconnected by a releasable interlocking joint assembly 22, consisting of a peripheral groove made thicknesswise of the four side edges of each quadrangular mat 10 to define four groove sections **24*a* to 24*d*. The two adjacent groove sections 24*a*** and 24*b* include a thin edgewise downturned lip or flange 26*a*, 26*b*, while the other two groove sections 24*c* and 24*d* include a similar thin edgewise lip or flange 28*c*, 28*d*, but which is upturned. The free ends of each flange 26, 28, extend short of each other so as to define two diagonally opposed flat corners 30. Moreover, grooves 24*a*, 24*b* and associated lips 26*a*, 26*b* project beyond the corresponding side edges 12*a*, 12*b* of the mat flat face 12, while grooves 24*c*, 24*d* and associated lips 28*c*, 28*d* project beyond the corresponding side edges 14*c*, 14*d* of mat main face 14 (see FIGS. 7 and 3 respectively).

It is also envisioned, as suggested in FIG. 1, that side ramps 11 be mounted to those mats 10 on the periphery of a large assembly of a plurality of interconnected mats. The side ramps 11 would be thicknesswisely tapering, so as to define a small slope, and their thickest side edge section would include a groove 24 and an edgewise lip 28 similar to those of the mats 10. The lip 28 of the ramp 11 would engage one groove 24 of a peripheral mat, so as to interconnect the ramp and this mat. Thus, access to the mats 10 would be facilitated by the ramps 11.

Hence, when two mats 10 are edgewisely connected, (or one mat 10 and one ramp 11) lip 26*a* or 28*c* of one side edge section of one mat is forcibly engaged into the corresponding peripheral thicknesswise groove 24*a* or 24*c* of the other mat. Since the mats are made from an elastomeric material, the mouth of the groove 24*a* or 24*c* yieldingly partially opens when the lip 26*a* or 28*c* extends thereinto, and then closes to bring the lip in frictional contact with the groove walls. Thus, these edge sections are frictionally interlocked wherein the two mats are coplanar. This frictional interlocking is releasable, by forcibly spreading apart, e.g. manually, the two legs of the corresponding peripheral groove sections.

Figure 3:
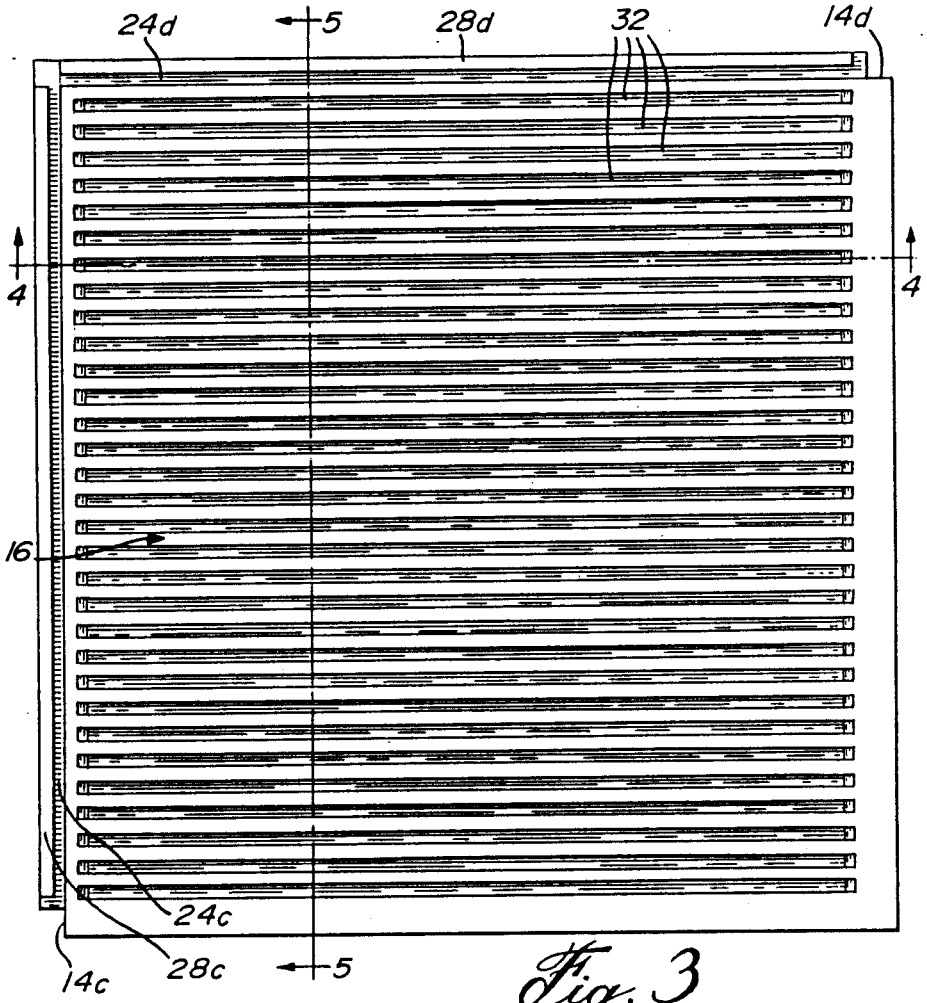
FIG. 3 is a top plan view of the grille section face of the mat of FIG. 1.
Figure 4:
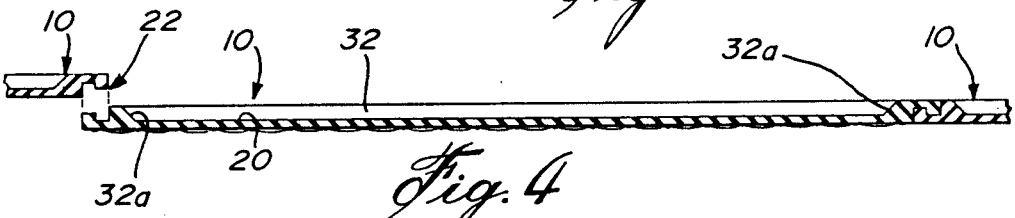
FIGS. 4–5 are cross-sectional views taken along lines 4—4 and 5—5 of FIG. 3 and of the edgewise sections of the two other mats, showing the interlocking capability of the edge sections of the reversible mats.
Figure 5:
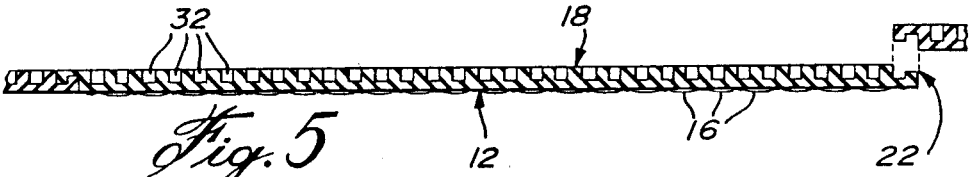

As shown in FIGS. 3–5, grille section 18 includes a plurality of parallel equally spaced lengthwise grooves 32, of square cross-section. The free ends of the grooves are upwardly outwardly tapering, as shown at 32*a* in FIG. 4.

Figure 2:
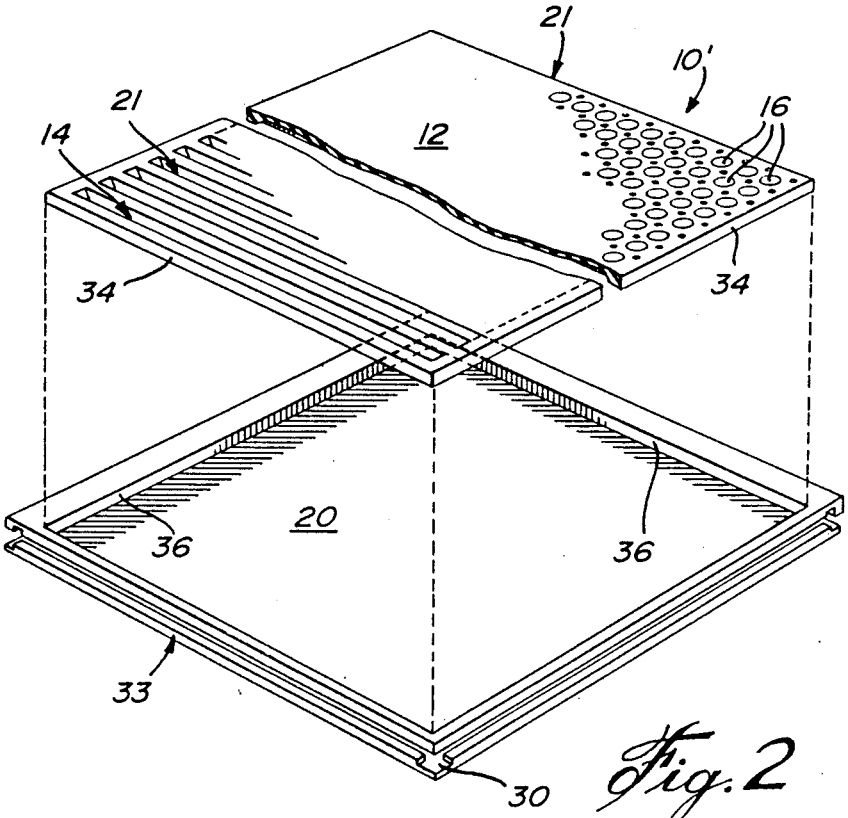
FIG. 2 is a partly broken perspective view of a second embodiment of reversible mat according to the invention, showing the two faces of a grille to be installed into the large recess of the frame of the mat.
Figure 8:
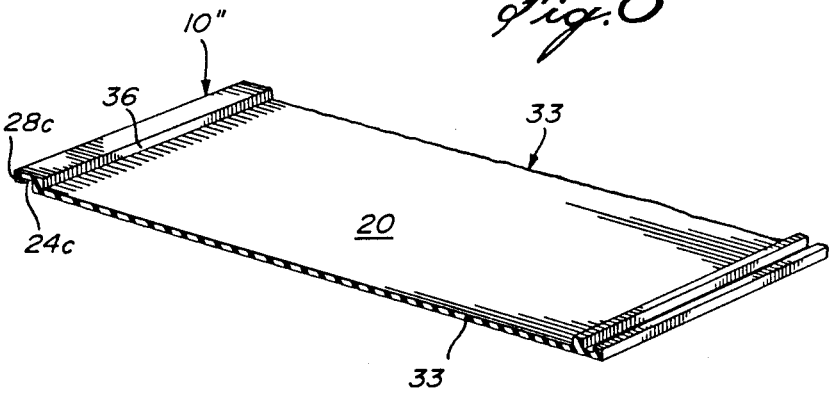
FIG. 8 is a broken perspective view of the bottom part of FIG. 2.

FIGS. 2 and 8 show a second and preferred embodiment including a removable carpet/grille section, 21, which defines four straight edges 34, while the mat frame proper, 33, defines a quadrangular recess 20 bounded by four thin straight walls 36 proximate to grooves 24*a*–24*d* and edgewisely frictionally engageable by the side edges 34 of the reversible carpet/grille 21. Carpet/grille 21 preferably has main faces 12 and 14 similar to the main faces of mat 10 of FIG. 1.

As shown in FIG. 8, the mat frame 33 is provided with interlocking lip and grooves 28*c* and 24*c* as in the first embodiment.

Figure 9:
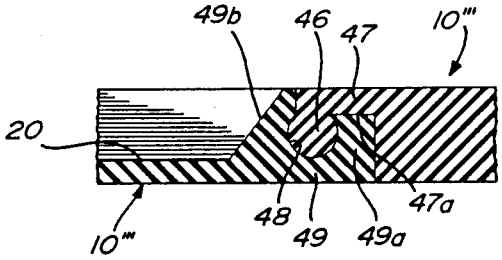
FIG. 9 is an enlarged cross-sectional view of the interlocked side edge sections of two reversible mats according to the invention, showing still another alternate embodiment of interlocking lip and groove assembly.

In FIG. 9, another mat 10''' similarly includes on at least one side edge section thereof at 47 a downturned lip 46, of substantially semi-circular cross-section, and on at least one other side edge section thereof, a cross-sectionally semi-circular lengthwise groove 48 whose mouth is slightly downwardly recessed, for frictional releasably engagement by the semi-circular lips of other mats 10'''.

The leg of side edge section 47 joining lip 46 to the main body of mat 10''', defines a flat underface, 47*a*, while lip 46 extends short of the level of the opposite main face of the mat. Groove 48 is bounded by an exterior side flange 49*a* and an interior side flange 49*b*: flange 49*a* is not as high as flange 49*b*, so that flange 49*a* snugly engage leg 47 to accommodate same at underface 47*a*, while flange 49*b* will act as a seat for the exterior side edge face of leg 47 including rounded lip 46.

The interlocking system of FIG. 9 can be applied to frame 33 of FIGS. 2 and 8 or to the unitary mat 10 of FIGS. 1 and 5.

Of course, variations in the shape of lips and mating grooves made thicknesswisely of the peripheral grooves of the mat's side edge sections, should be considered well within the scope of this invention. Such a preferred variation is shown in FIG. 10 wherein each mat 10' has interlocking lips 46*a* and 60 which are of dovetailed cross-section.

Figure 10:
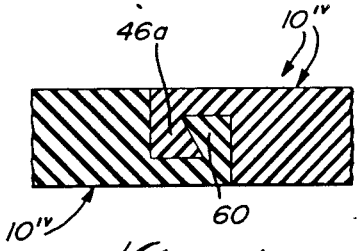
FIG. 10 is a cross-section of yet another embodiment of the interlocking lip and groove assembly.

Obviously, the embodiments of FIGS. 9 and 10 are more difficult to take apart and therefore accidental release of adjacent mats is prevented.

I claim:

1. In combination, (a) a first and a second mat, each mat defining: a substantially flat wall member, an opposite grille wall member, and at least a first straight edge section edgewisely of said flat wall member and grille wall member; and (b) fastening means, releasably interconnecting said first edge sections of said first and second mats to bring said mats substantially coplanar to each other; wherein said fastening means includes a tenon member, defining an inner end integral to said first mat and an elongated ridge projecting from said tenon member inner end transversely to the plane of the first mat and made from a flexible, resilient, yet sturdy material, and a mortise member, defining a body portion integral to said second mat and a narrow mouth opening into a larger groove the latter thicknesswisely extending through said second mat lengthwisely of said first edge section thereof, said mortise member body portion made from a flexible, resilient, yet sturdy material, said ridge defining an enlarged outer end releasably engaged into said groove the latter being conformed to receive said ridge, said tenon and mortise members extending along substantially the whole length of said first edge sections of said first and second mats respectively but remaining positively within the plane of said interconnected mats; ingress/egress of said ridge into/from said groove being made through temporary physical deformation of said mortise members body portion and of said tenon member ridge when the latter frictionally extends through said mortise member mouth; and wherein said tenon member ridge includes a reversed edge.

2. A pair of interconnected mats as defined in claim 1, wherein said tenon and mortise members form a dovetail joint.

3. In combination, (a) a first and a second mat, each mat defining: a substantially flat wall member, an opposite grille wall member, and at least a first straight edge section edgewisely of said flat wall member and grille wall member; and (b) fastening means, releasably interconnecting said first edge sections of said first and second mats to bring said mats substantially coplanar to each other; wherein said fastening means includes a tenon member, defining an inner end integral to said first mat and an elongated ridge projecting from said tenon member inner end transversely to the plane of the first mat and made from a flexible, resilient, yet sturdy material, and a mortise member, defining a body portion integral to said second mat and a narrow mouth opening into a larger groove the latter thicknesswisely extending through said second mat lengthwisely of said first edge section thereof, said mortise member body portion made from a flexible, resilient, yet sturdy material, said ridge defining an enlarged outer end releasably engaged into said groove the latter being conformed to receive said ridge, said tenon and mortise members extending along substantially the whole length of said first edge sections of said first and second mats respectively but remaining positively within the plane of said interconnected mats; ingress/egress of said ridge into/from said groove being made through temporary physical deformation of said mortise members body portion and of said tenon member ridge when the latter frictionally extends through said mortise member mouth; wherein said tenon member ridge forms a curved bulge at its outer end, of substantially C-shape contour.

4. In combination, (a) a first and a second mat, each mat defining: a substantially flat wall member, an opposite grille wall member, and at least a first straight edge section edgewisely of said flat wall member and grille wall member; and (b) fastening means, releasably interconnecting said first edge sections of said first and second mats to bring said mats substantially coplanar to each other; wherein said fastening means includes a tenon member, defining an inner end integral to said first mat and an elongated ridge projecting from said tenon member inner end transversely to the plane of the first mat and made from a flexible, resilient, yet sturdy material, and a mortise member, defining a body portion integral to said second mat and a narrow mouth opening into a larger groove the latter thicknesswisely extending through said second mat lengthwisely of said first edge section thereof, said mortise member body portion made from a flexible, resilient, yet sturdy material, said ridge defining an enlarged outer end releasably engaged into said groove the latter being conformed to receive said ridge, said tenon and mortise members extending along substantially the whole length of said first edge sections of said first and second mats respectively but remaining positively within the plane of said interconnected mats; ingress/egress of said ridge into/from said groove being made through temporary physical deformation of said mortise members body portion and of said tenon member ridge when the latter frictionally extends through said mortise member mouth; further including three other mats, each of the five mats being quadrangular and defining one pair of opposite edgewise sections into each of which is embodied a tenon member and another pair of opposite edgewise sections into each of which is embodied a mortise member, said second and three other mats being releasably edgewisely connected to a corresponding one of the four side edge sections of said first mat.

5. A pair of interconnected mats as defined in claim 4, wherein each said mat is made from a resilient, flexible, sturdy material; wherein said tenon and mortise members includes means to prevent release of said fastening means simply by the bending of a mat out of the other mats common plane; said fastening means release being possible through means for forcibly spreading apart the wall sections of the mortise member groove of one mat, and thereafter pivoting the latter mat relative to the other mats initial common plane.

6. A pair of interconnected mats as defined in claim 5, wherein said tenon and mortise members form a dovetail joint.

7. A pair of interconnected mats as defined in claim 5, wherein said tenon member ridge forms a curved bulge at its outer end, of substantially C-shape contour.

* * * * *